US007972048B1

(12) United States Patent
Lamborn

(10) Patent No.: US 7,972,048 B1
(45) Date of Patent: Jul. 5, 2011

(54) WINDOW MOUNTED SOLAR POWERED NIGHT LIGHT

(76) Inventor: Sarah Jane Lamborn, Northbridge, MA (US)

( * ) Notice: Subject to any disclaimer, the term of this patent is extended or adjusted under 35 U.S.C. 154(b) by 357 days.

(21) Appl. No.: 12/187,573

(22) Filed: Aug. 7, 2008

(51) Int. Cl.
*H01R 33/00* (2006.01)

(52) U.S. Cl. ..... 362/541; 362/249.01; 362/382; 362/396; 362/397; 362/647

(58) Field of Classification Search ..... 362/121, 362/249.01–249.02, 249.06, 249.12, 249.14, 362/349.16–349.17, 253, 382, 396–397, 362/640–641, 644, 647, 800–801, 806–807, 362/249.16–249.17
See application file for complete search history.

(56) References Cited

U.S. PATENT DOCUMENTS

| | | | | |
|---|---|---|---|---|
| 2,146,859 | A * | 2/1939 | Seklehner | 248/467 |
| 4,823,241 | A | 4/1989 | Trattner | |
| 5,422,803 | A * | 6/1995 | Kilgore | 362/392 |
| 5,564,816 | A * | 10/1996 | Arcadia et al. | 362/183 |
| 5,613,764 | A * | 3/1997 | O'Brien | 362/307 |
| 5,618,100 | A | 4/1997 | Glynn | |
| 6,929,381 | B2 | 8/2005 | Peterson | |
| 6,951,408 | B2 * | 10/2005 | Stewart | 362/183 |
| 7,360,918 | B2 | 4/2008 | Trombetta et al. | |

FOREIGN PATENT DOCUMENTS

| | | |
|---|---|---|
| DE | 202006011319 U | 10/2006 |
| DE | 202006011320 U | 10/2006 |
| JP | 62150324 | 7/1987 |
| JP | 9279524 | 10/1997 |
| JP | 2006211068 | 8/2006 |
| KR | 20030065098 | 8/2003 |
| SE | 8601317 | 9/1987 |

* cited by examiner

*Primary Examiner* — Stephen F Husar
*Assistant Examiner* — Meghan K Dunwiddie
(74) *Attorney, Agent, or Firm* — Michael I. Kroll

(57) ABSTRACT

A window mounted solar powered night light has a structural attachment fastener, a lighting module; and a holder for attaching the lighting module to the attachment fastener. The lighting module includes a light emitting diode, a rechargeable battery, a solar cell for recharging the battery, and a switch for turning the light emitting diode on and off. A housing maintains the various elements of the lighting module in circuit communication.

14 Claims, 13 Drawing Sheets

WINDOW MOUNTED SOLAR POWERED NIGHT LIGHT

BACKGROUND OF THE INVENTION

1. Field of the Invention

The present invention relates generally to lamps and, more specifically, to a solar powered night light comprising a mount, preferably a suction cup having a stud rearwardly extending engageable by a holder having a pair of spaced apart legs for straddling the suction cup stud with a bracket for receiving the illuminating device, which incorporates housing having a rechargeable power source in circuit communication with a switch, lamp and solar cell for recharging the power source. The housing can be manufactured in various shapes such as round, oval, rectangular and square with a universal clip-on receiver for mounting a shade, star, seashell or other ornamental article. Alternately the universal clip-on receiver may have a displaceable portion for mounting ornamental covers with clip of varying thickness.

2. Description of the Prior Art

There are other lamp device designed for night lights. Typical of these is U.S. Pat. No. 4,823,241 issued to Trattner on Apr. 18, 1989.

Another patent was issued to Glynn on Apr. 8, 1997 as U.S. Pat. No. 5,618,100. Yet another U.S. Pat. No. 6,929,381 was issued to Peterson on Aug. 16, 2005 and still yet another was issued on Apr. 22, 2008 to Trombetta et al. as U.S. Pat. No. 7,360,918.

Another patent was issued to Mitsuhiro on Jul. 4, 1987 as Japan Patent No. JP62150324. Yet another Sweden Patent No. SE8601317 was issued to Svensson on Sep. 21, 1987. Another was issued to Hitomi on Oct. 28, 1997 as Japan Patent No. JP9279524 and still yet another was issued on Aug. 6, 2003 to Eo as Korean Patent No. KR20030065098.

Another patent was issued to Kanazawa on Aug. 10, 2006 as Japan Patent No. JP2006211068. Yet another German Patent No. DE202006011319U was issued to Barchet on Oct. 5, 2006 and still yet another was issued on Oct. 5, 2006 to Barchet as German Patent No. DE202006011320U.

U.S. Pat. No. 4,823,241

Inventor: Burton Trattner

Issued: Apr. 18, 1989

A portable lamp unit having adhesive strips for mounting upon the interior surface of a hatch back automobile window. A mercury switch permits the lamp to be lit only when the hatch back lid is open. A solar cell aligned with and receiving sunlight through the window charges the batteries. The lamp housing is swingably mounted and a detent enables the lamp to be retained in one of a number of different orientations to direct light to a selected region, and may be releasably locked in any one of a variety of positions to compensate for various open hatch angles to direct the focussed light rays upon the desired region of the storage space. A switch selectively opens the power loop to prevent unnecessary drainage of the batteries when the hatch back is opened for a long periods of time. A light transmissive adhesive may be utilized to mount the unit upon a window. Alternatively, a frame may be mounted to the window to snap fittingly releasably retain the lamp unit in position upon the hatch back window.

U.S. Pat. No. 5,618,100

Inventor: Kenneth P. Glynn

Issued: Apr. 8, 1997

The present invention is a solar powered flat, electroluminescent lamp night light adapted to be placed upon or attached to a window sill. The night light has a vertical upper portion which retains a solar cell unit that faces toward the window when the night light is placed on the window sill. The night light also has a horizontal middle section which is either adapted to rest upon a window sill, thereby balancing the night light in place, or adapted to attach the night light directly to the a portion of the window sill. The night light also a vertical lower portion which houses a flat, electroluminescent sheet light source. When the night light is placed upon a window sill, the flat, electroluminescent sheet light source faces into the room and illuminates the area of interest. The solar cell unit is configured to receive sunlight and convey electrical current to the flat, electroluminescent sheet light source and to an energy retaining device. The device could also have a set of sensors which determines if the night light should be on or off. A switch could also be provided for manual operation.

U.S. Pat. No. 6,929,381

Inventor: Darleen A. Peterson

Issued: Aug. 16, 2005

The electric candle light has an elongated shaft that appears as the stick of a wax candle. A light source is disposed at the top end of the elongated shaft. A photoelectric cell is disposed around the top end of the elongated shaft below the light source. A rechargeable battery is coupled to both the light source and the photoelectric cell. The rechargeable battery supplies electricity to the light source and is recharged by the photoelectric cell.

U.S. Pat. No. 7,360,918

Inventor: Vince Trombetta et al

Issued: Apr. 22, 2008

Disclosed herein is an improved high-efficiency solar-charging electric window candle comprising a base adapted to sit securely upon a window sill. The base includes a footer formed with a battery compartment accessible through a bottom hatch, and a riser protruding upwardly from the footer with upwardly inclined side surfaces. The riser also has a compartment for enclosing a circuit board, and a vertically-oriented collar. A rechargeable battery is mounted in the footer of said base, and a hollow cylindrical candle body is inserted in the collar of the base riser, and a bulb assembly comprising a white LED is mounted atop the candle body. A circuit board is enclosed in the riser and includes two circuits: a current pump for supplying a pulsed current, and a photosensing circuit for sensing ambient light levels. The charge pump circuit reduces current requirements of the white LED, and the photosensing circuit automatically detects ambient light levels and illuminates the white LED while disconnecting the rechargeable battery, or vice versa, depending on whether there is sufficient ambient light.

Japan Patent Number JP62150324

Inventor: Mitsuhiro Kawamata et al

Issued: Jul. 4, 1987

PURPOSE: To lead in enough an external light beam from a lighting window in the daytime, and to prevent a light leak from the lighting window at night, by providing an electrochromic display element whose transmittivity is varied by applying a voltage, on the lighting window. CONSTITUTION: A display window 12 is provided in front of a housing 11, and in the rear of this display window 12, a liquid crystal display element 13 is provided. On the rear surface of this liquid crystal display element 13, a semipermeable light leading body 14 is provided, and in case a light source 15 is lighted at night, etc., an internal light beam which is emitted from the light source 15 and reflected from a curved reflecting plate 16 is led to the liquid crystal display element 13 aide. Also, on the housing 11 of the upper face side of the light leading body 14, a lighting window 17 for taking in an external light beam such as a solar light, etc., is pierced, and an electrochromic display element 18 having an optical shutter function for controlling passing of a light beam is fitted into this lighting window 17.

Sweden Patent Number SE8601317

Inventor: Kjell Ingvar Svensson

Issued: Sep. 21, 1987

The solar cell has one side either of magnesian oxide or which is transparent to both visible and infra-red light. The other side is of common salt, which is likewise transparent to both forms of light, so that it can be thick without impeding light from reach the stop layer.—Neither side of the cell must be blocked, but is allowed to take in light at all times. They are N or P-conducting materials, the connecting material being copper, temperature being able to rise to approx. 500 deg.C. Since both sides are penetrable by infra-red light, the resultant heat may be converted to electrical energy. The cell can be used as a window, utilised daylight during the day, and internal light at night. If it is required to use heat from one side, e.g. the inside, instead of converting it to electrical energy, quartz can be used instead of magnesium oxide.

Japan Patent Number JP9279524

Inventor: Takeshi Hitomi

Issued: Oct. 28, 1997

PROBLEM TO BE SOLVED: To attain size reduction and cost reduction by accumulating electric energy generated by a solar light power generating unit in an electric double layer capacitor. SOLUTION: A solar battery panel is arranged in the center of a rivet main body 6, and a power generation light emission control part 8 is arranged under it, and an electric double layer capacitor 9 is arranged in a cavity of these. An LED 10 being a light emitting part is arranged in a place corresponding to a front face, and is constituting so as to emit the alarm light from a front light emitting window, and is formed as a solar battery type self-light emitting type road rivet. This solar battery type self-light emitting road rivet is stuck to and arranged on curbs on the road side of a road. Therefore, power generation and charging can be performed even in a day when the sunlight is not shown upon like rainy weather and snowfall time, and since it can cope with light emitting flashing discharge in the night, the light is always emitted even under any weather condition, and there is no need to adjust a power generating panel toward the sun, and a function can be exhibited even in a zone of cold.

Korea Patent Number KR20030065098

Inventor: Ik Soo Eo

Issued: Aug. 6, 2003

PURPOSE: A window-type solar lighting system for a DC(Direct Current)/AC(Alternating Current) lighting apparatus in a house is provided to improve the reliability and the efficiency by installing a solar board on a window and a balcony and providing a solar lighting panel on a distribution board. CONSTITUTION: A solar cell(20) converts light energy of the sun into electricity energy. A battery(21) stores power so as to use it at night. A DC regulator(22) maintains an unstable voltage as a constant voltage. A battery controller (23) determines an over-charge state and an under-charge state. An inverter(24) converts DC into AC when using AC. A boosting device(25) boosts the converted AC. A 220V AC-power is boosted by the boosting device(25) through the DC regulator(22) and the inverter(24) and supplied to a load(28) through an ELB(Earth Leakage Breaker)(29) which is an earth detector.

Japan Patent Number JP2006211068

Inventor: Ritsuko Kanazawa

Issued: Aug. 10, 2006

PROBLEM TO BE SOLVED: To provide a virtual window system whereby a user can obtain natural lighting and scenery similarly to a real window.
SOLUTION: In the virtual window system comprising: a lighting device whose illuminance can be changed; a video display device; a solar battery for supplying power to the system; a camera connected to the video display device and transmitting a photographed video image thereto; and a controller for controlling apparatuses connected thereto, which changes the illuminance of the lighting device on the basis of the electric power generation of the solar battery, a date and a present time, employs environmental performance such as the increased illuminance of white light bulbs at the daytime of a fine day to obtain a bright environment thereby illuminating a room as if light is received through a real window, and controls the start/stop of capturing the video image of the camera on the basis of the electric power generation of the solar battery, the date and the present time to carry out energy-saving drive wherein useless video photographing at night is limited thereby attaining the operation of the virtual window system.at a low cost.

German Patent Number DE202006011319U

Inventor: Heinrich Barchet

Issued: Oct. 5, 2006

A solar lamp has a solar module fixed pointed outwards on a window pane via a suction mounting according to the size and weight of the unit, having up to four pieces. Independent claims are included for the following: (1) (A) A very bright LED lighting body. (2) (B) A dazzle-protection element.

German Patent Number DE202006011320U

Inventor: Heinrich Barchet

Issued: Oct. 5, 2006

A solar lamp has a module pointing outwards and is fixed on a window pane via suction mountings according to the size and weight of the units of the module, up to four units in total. The window decoration is provided with a light source on the window sill and is connected by an electric lead. The solar module points outwards with the housing and the window decoration, with the light source on the window sill.

While these illuminable devices may be suitable for the purposes for which they were designed, they would not be as suitable for the purposes of the present invention, as hereinafter described.

SUMMARY OF THE PRESENT INVENTION

A primary object of the present invention is to provide a solar powered night light.

Another object of the present invention is to provide a solar powered night light enabled with a window mount.

Yet another object of the present invention is to provide a solar powered night light wherein the window mount is a suction cup.

Still yet another object of the present invention is to provide a solar powered night light having a suction cup incorporating a rearwardly depending stud A further object of the present invention is to provide a solar powered night light with a suction cup mountable holder having a bracket for receiving an illuminating device and a pair of spaced apart legs for straddling the suction cup stud and retained thereon by said stud.

A yet further object of the present invention is to provide a solar powered night light having a housing incorporating a lamp in circuit communication with a rechargeable power source, switch and solar cell for recharging said power source.

A still yet further object of the present invention is to provide a solar powered night light having a housing manufactured in a plurality of shapes, such as round, oval, rectangular and square.

Another object of the present invention is to provide a solar powered night light housing incorporating a universal clip-on receiver for attaching ornamental articles, such as, shade, star, sea shell and other ornamental covers.

Yet another object of the present invention is to provide an alternate universal clip-on receiver wherein one of the ridges is displaceable either frictionally or threadedly to receive ornamental covers with varying clip-on thicknesses.

Additional objects of the present invention will appear as the description proceeds.

The present invention overcomes the shortcomings of the prior art by providing a solar powered night light comprising a mount, preferably a suction cup having a stud rearwardly extending engageable by a holder having a pair of spaced apart legs for straddling the suction cup stud with a bracket for receiving the illuminating device, which incorporates housing having a rechargeable power source in circuit communication with a switch, lamp and solar cell for recharging the power source. The housing can be manufactured in various shapes such as round, oval, rectangular and square with a universal clip-on receiver for mounting a shade, star, seashell or other ornamental article. Alternately the universal clip-on receiver may have a displaceable portion or mounting ornamental covers with clip of varying thickness.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
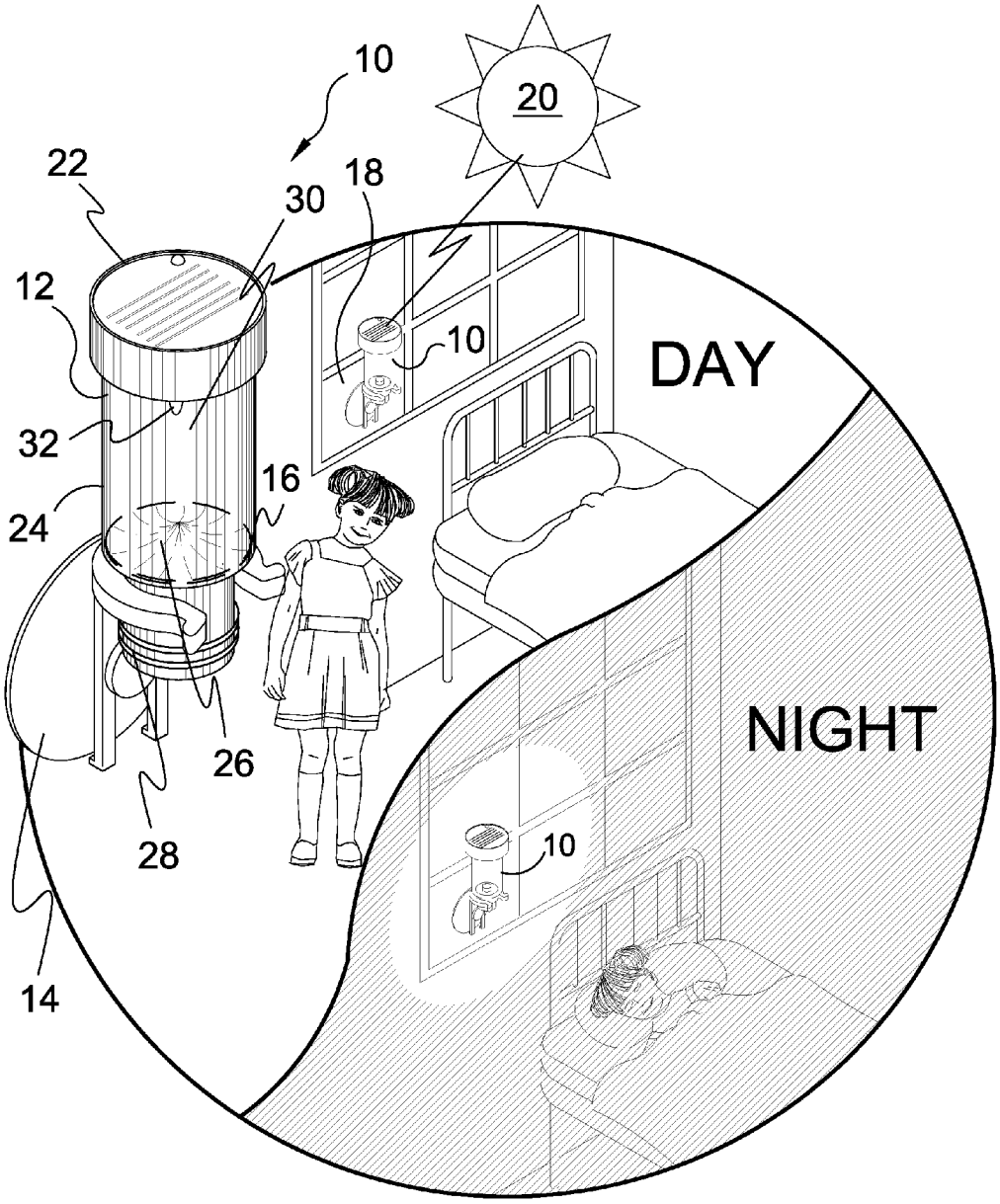
FIG. 1 is an illustrative view of the solar powered night light in use.

Turning now descriptively to the drawings, in which similar reference characters denote similar elements throughout the several views, the figures illustrate the Solar Powered Night Light of the present invention. With regard to the reference numerals used, the following numbering is used throughout the various drawing figures.

10 Solar Powered Night Light of the present invention
12 lighting module
14 structural attachment fastener
16 holder
18 window
20 sun
22 solar cell
24 housing of 12
26 reflector

28 universal clip-on receiver
30 light diffuser
32 light emitting diode (LED)
34 suction cup
36 stud
38 leg of 16
40 arm of 16
42 suction cup support pin
44 pin aperture
46 electrical circuit
48 battery
50 wall of 24
52 ornamental shade
54 ridges of 28
56 on/off switch
58 shade attachment clip
60 threads
62 light beams
64 interior structure
66 exterior structure
68 window screen
70 hook fastener

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the solar powered night light 10 in use. Shown is the solar powered night light 10 comprising structural attachment fastener 14, lighting module 12 and holder 16 for attaching the lighting module 12 to the attachment fastener 14 secured to a window 18 to harvest potential energy from the sun 20. The lighting module 12 incorporates a lamp circuit and a housing 24 having a reflector 26, light diffusing portion 30 and universal clip-on receiver 28 for attachment of a shade or other clip-on ornamental article. The lamp circuit preferably comprises at least one LED 32 powered by at least one rechargeable battery, at least one solar cell 22 for recharging the at least one battery and switch for engaging and disengaging the illumination of the at least one LED 32.

Figure 2:
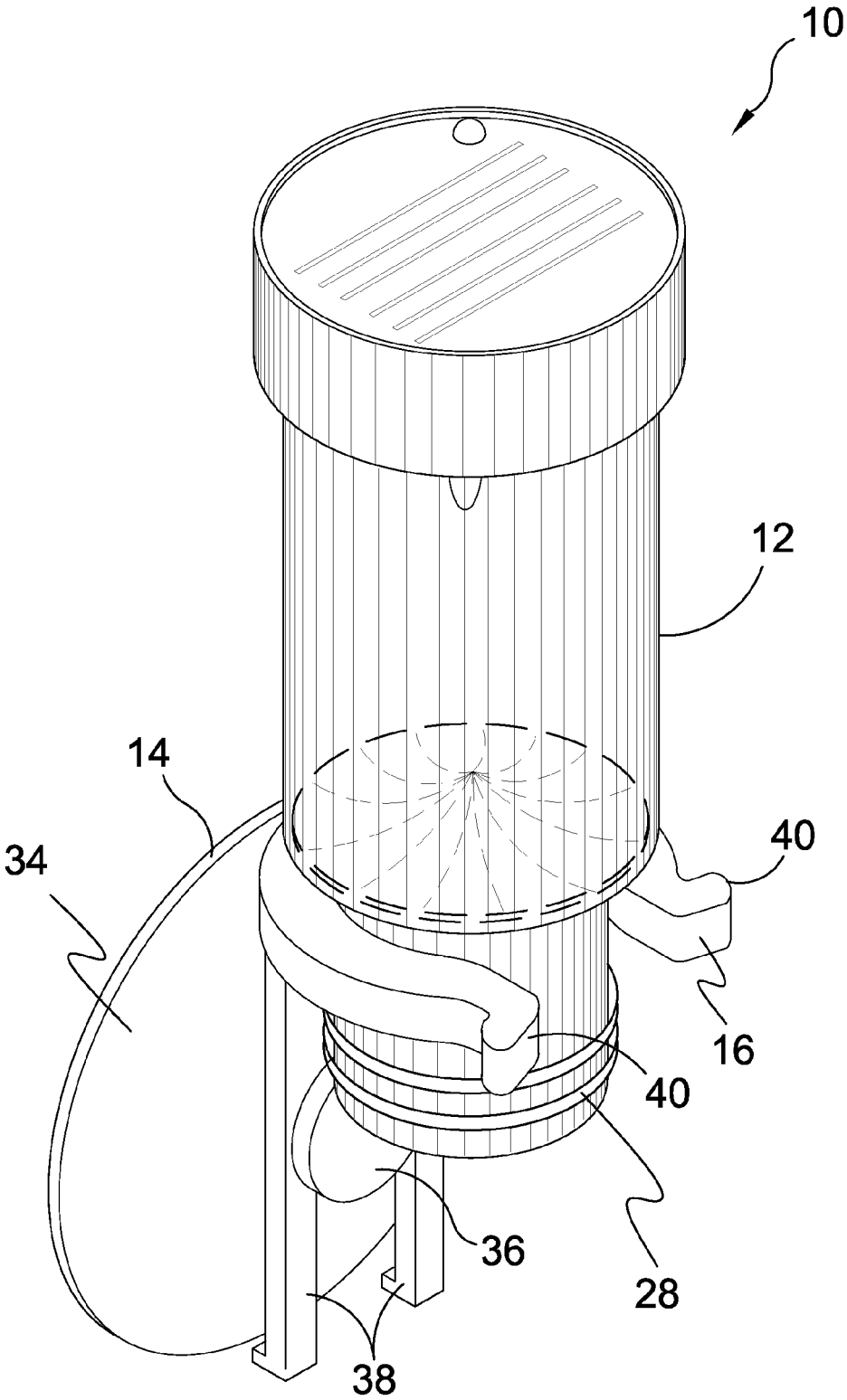
FIG. 2 is a perspective view of the solar powered night light.

FIG. 2 is a perspective view of the solar powered night light 10. Shown is the solar powered night light 10 comprising a suction cup 34 serving as structural attachment fastener 14 having a stud 36, a holder 16 having a pair of spaced apart legs 38 for straddling the suction cup stud 36 and a pair of pliable arms 40 for mounting the lighting module 12 therein and a lighting module 12, which can be used as a standalone night light or in concert with any decorative shade having a clip-like mounting mateable to the lighting module universal clip-on receiver 28.

Figure 3:
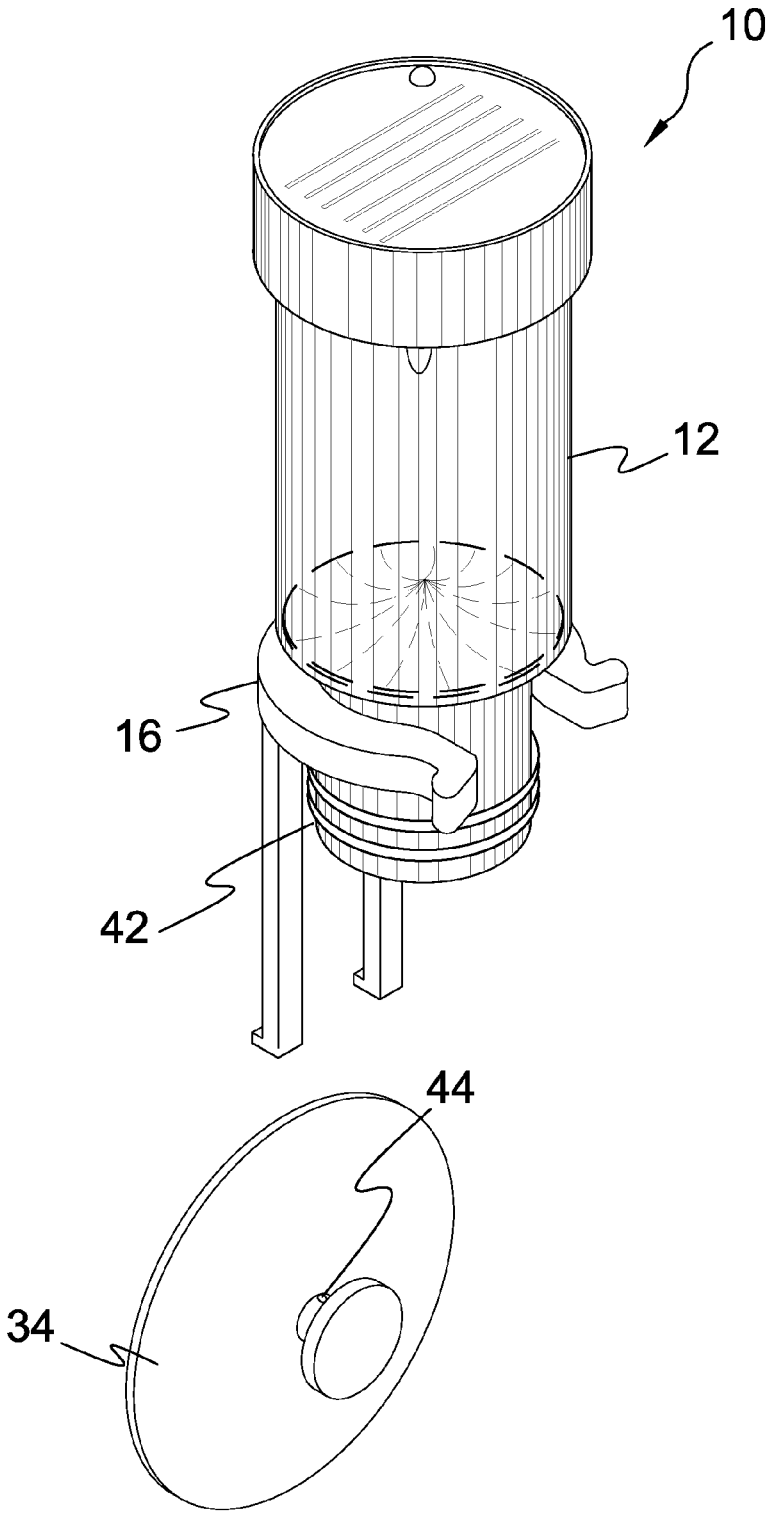
FIG. 3 is an exploded view of the solar powered night light.

FIG. 3 is an exploded view of the solar powered night light 10. The solar night light 10 optionally provides for mating anti-slippage elements, such as pin 42 and aperture 44 between the suction cup 34 and holder 16 to prevent rotation of the lighting module 12 and holder 16 relative to the suction cup 34 when mounted thereon.

Figure 4:
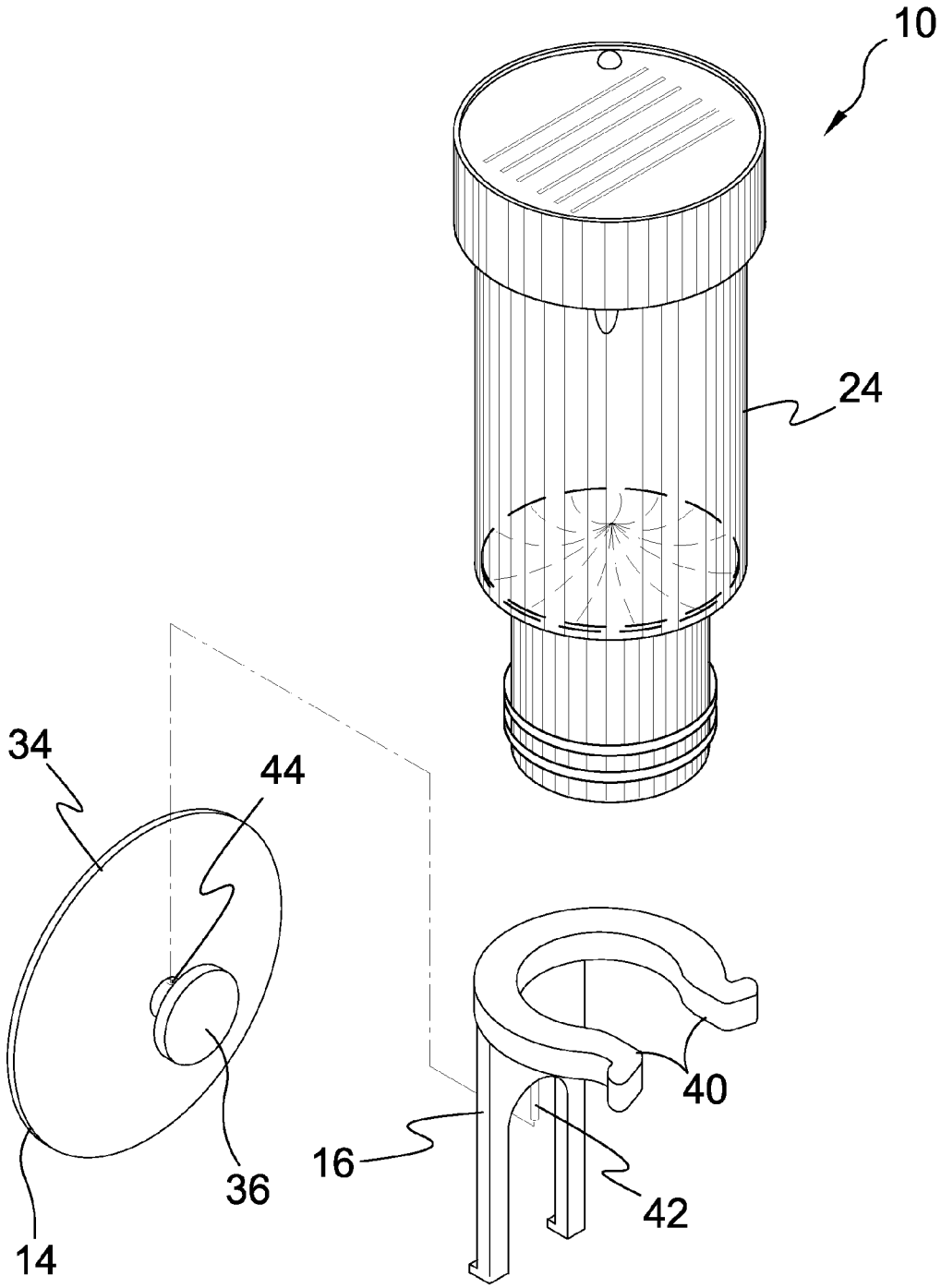
FIG. 4 is an exploded view of the present invention.

FIG. 4 is an exploded view of the present invention 10. Illustrated is the night light housing 24, which may be manufactured in various decorative shapes, night light housing holder 16 having arms 40 for receiving the housing 24 therein and a structural attachment fastener 14 comprising a suction cup 34 with a rearwardly extending stud 36 with a pin aperture 44 to receive the suction support pin 42 depending downwardly from the holder 16 for supporting and maintaining the holder 16 once placed thereon.

Figure 5:
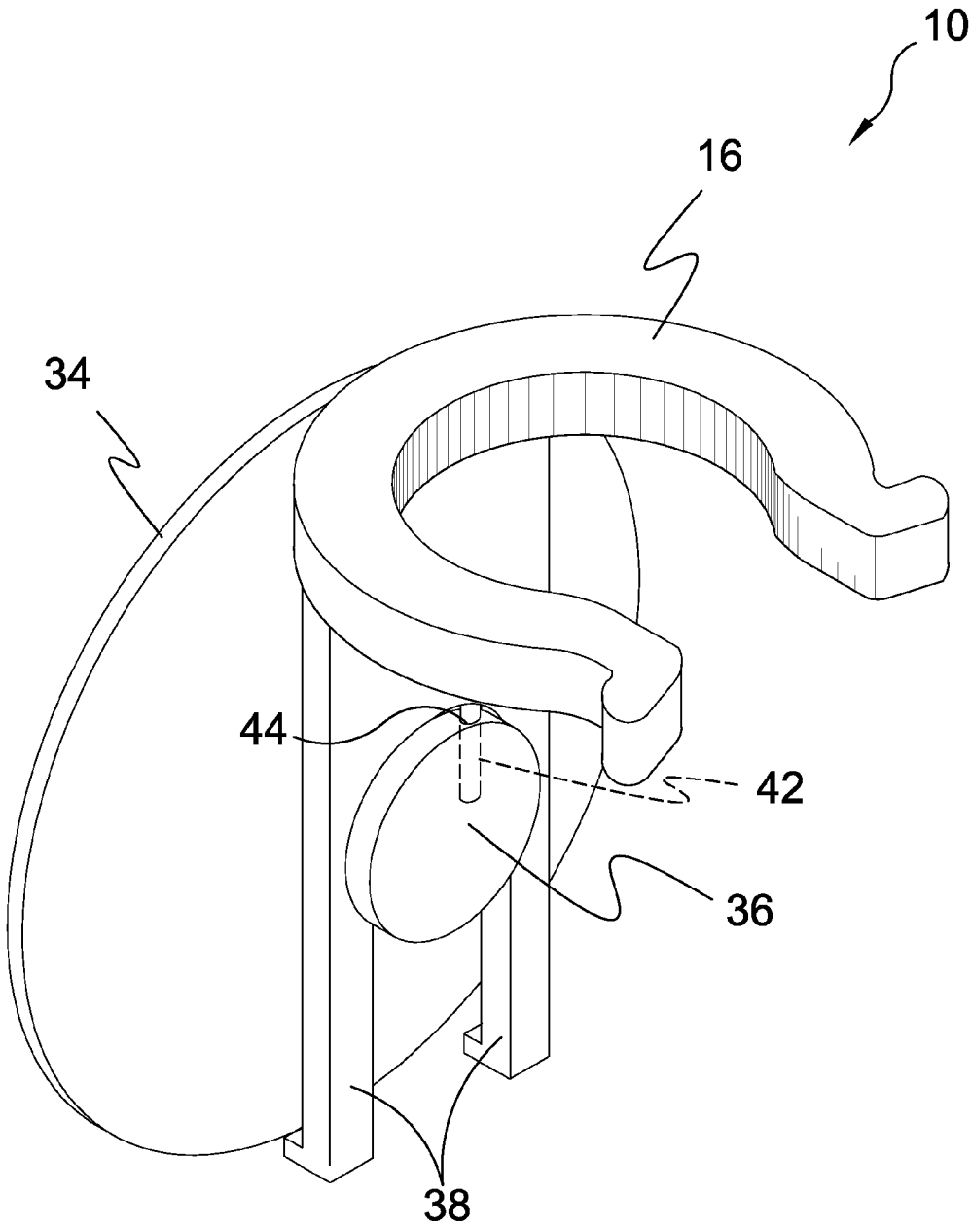
FIG. 5 is a perspective view of the suction cup and holder of the solar powered night light.

FIG. 5 is a perspective view of the suction cup 34 and holder 16 of the present invention 10. The solar night light is mountable to a window by a suction cup 34 with the night light holder 16 mounted to the suction cup 34 and held in place by spaced apart legs 38 straddling the suction cup stud 36 with the present invention 10 optionally providing for anti-slippage elements, such as a mating pin 42 and aperture 44 between the suction cup 34 and holder 16 to prevent rotation of the lighting module and holder 16 relative to the suction cup 34 when mounted thereon.

Figure 6:
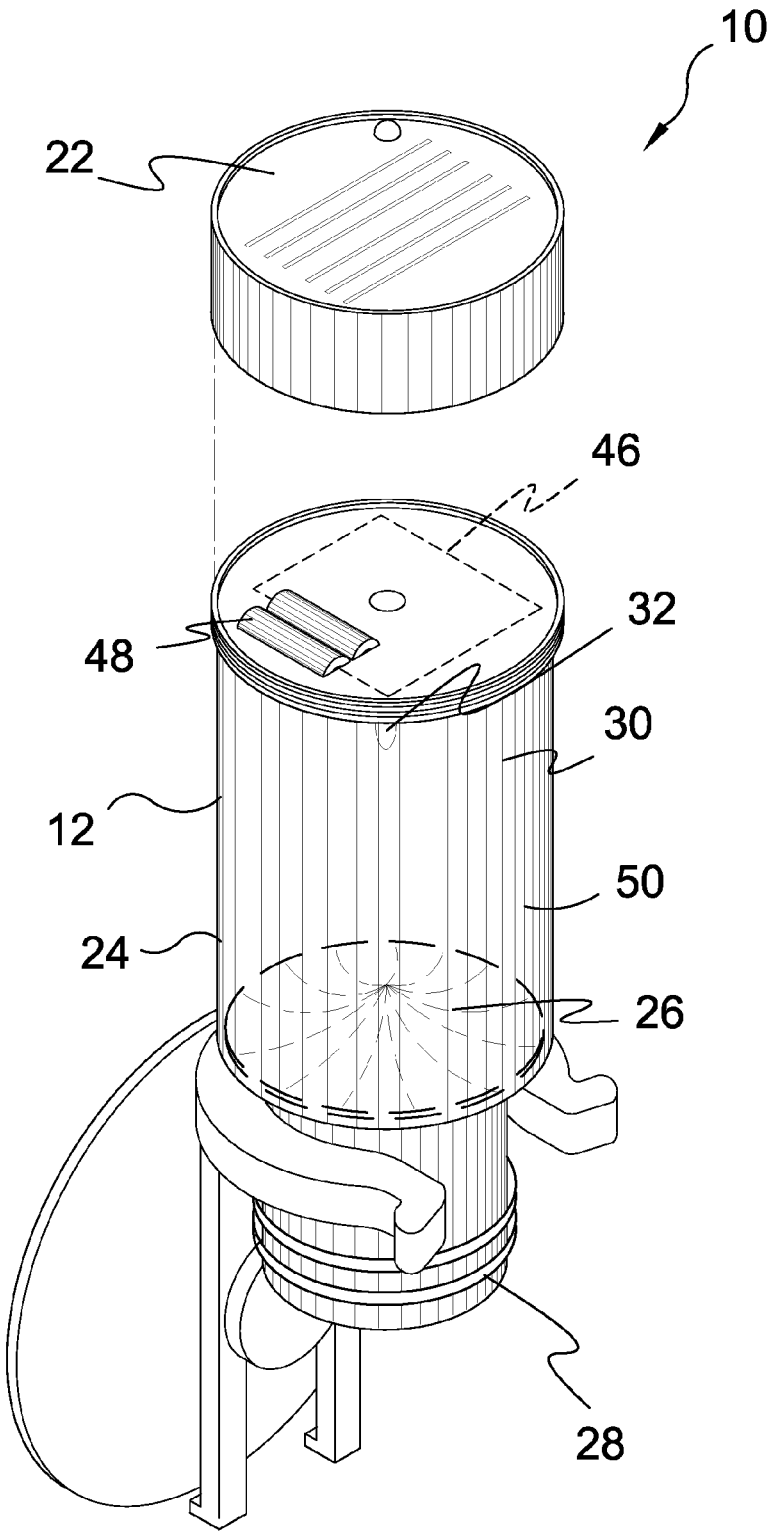
FIG. 6 is an exploded view of the present invention.

FIG. 6 is an exploded view of the present invention 10. Shown is an exploded perspective view of the solar night light 10 with the top portion of the lighting module 12 with solar cell removed providing access to the interior which houses an electrical circuit 46 comprising one or more batteries 48, at least one LED 32 and switch for engaging and disengaging the illumination of the lighting module 12. The lighting module housing 24 further comprises transparent or translucent wall 50 serving as light diffuser 30 with a base positioned reflector 26. The present invention further provides that while the shape of the lighting module housing 24 is depicted as round other shapes such as oval, rectangular and square are also possible. It is envisioned that the lighting module housing 24 of any shape provides a universal clip-on receiver 28 whereby a shade or other clip-on ornamental article, such as star, sea shell or other decorative article can be releasably attached thereto.

Figure 7:
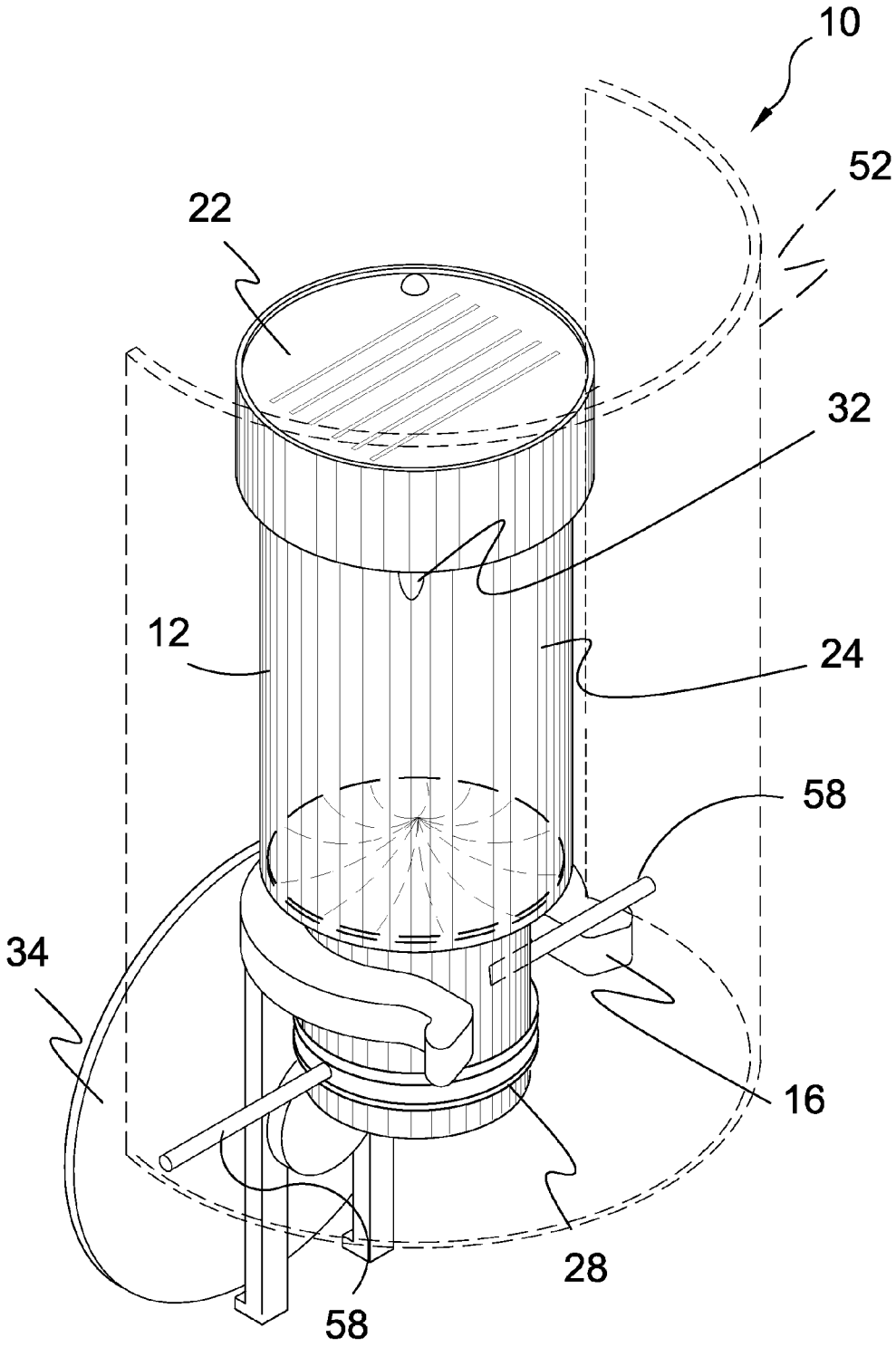
FIG. 7 is an illustrative view of the present invention having an optional ornamental shade.

FIG. 7 is an illustrative view of the present invention 10 having an optional ornamental shade 52 and shade attachment clip 58. Shown is the solar night light 10 mountable by a suction cup 34 to a window having a holder 16 and lighting module 12 comprising a solar cell 22 for illuminating a LED 32. The electrical circuit uses rechargeable batteries and solar cells as the battery recharging medium. The housing 24 incorporates a universal clip-on receiver for mounting variously ornamental shades 52, star, seashell and other ornamental covers.

Figure 8:
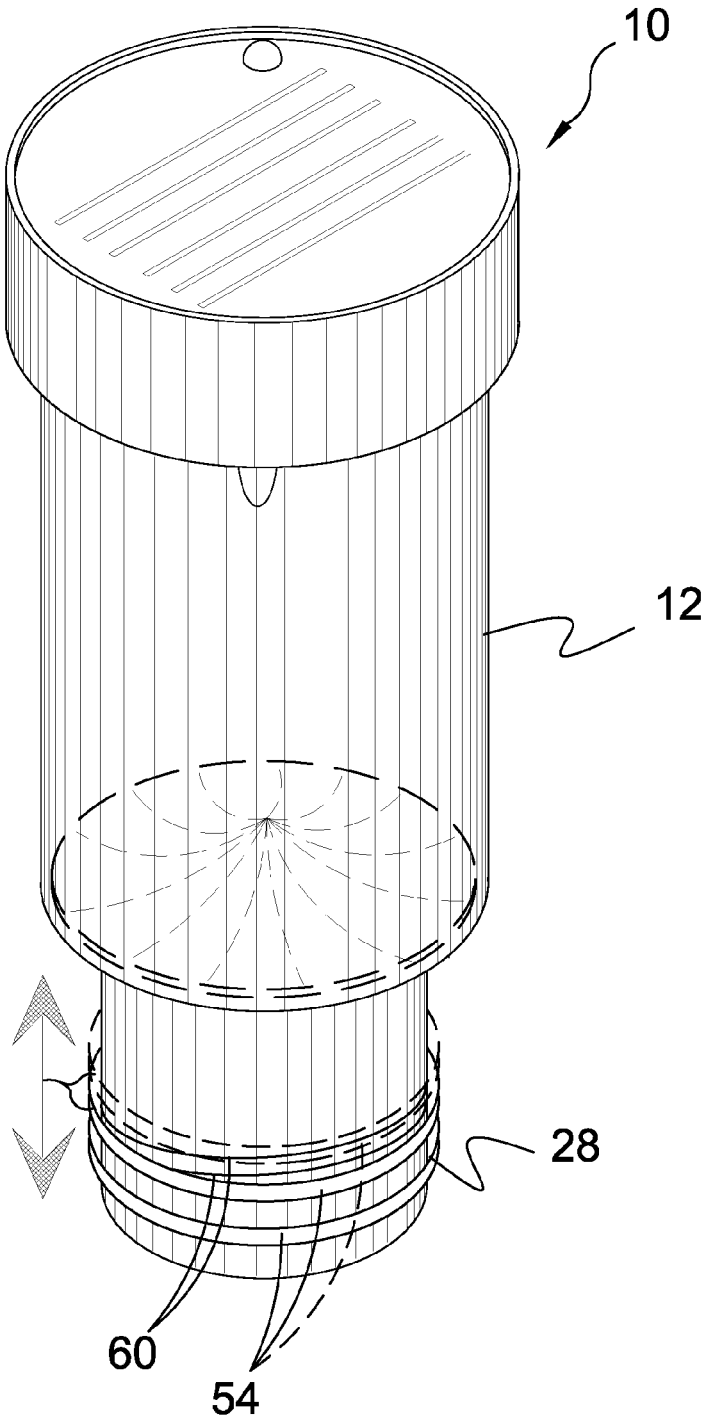
FIG. 8 is a perspective view of an additional element of the present invention.

FIG. 8 is a perspective view of an additional element of the present invention 10. The present invention 10 alternately provides that the universal clip-on receiver 28 on the lighting module 12 may be manufactured wherein either the top or bottom ridges 54 may be displaceable frictionally or threadedly via threads 60 so that the spacing between the universal clip-on ridges 54 can be user selectively adjusted to accept clip-on ornamental articles of other thicknesses.

Figure 9:
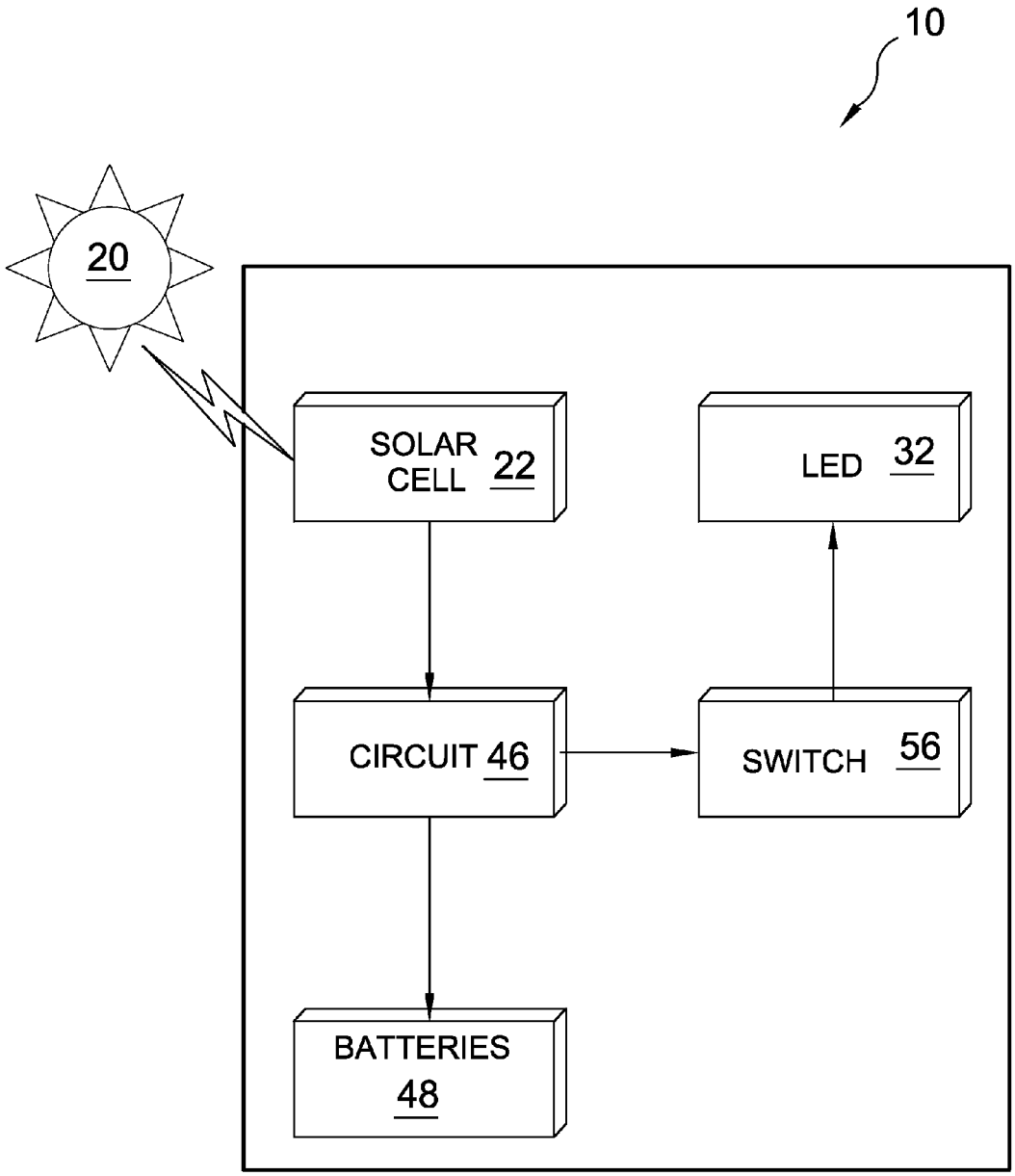
FIG. 9 is a block diagram of the solar powered night light.

FIG. 9 is a block diagram of the solar powered night light 10. Shown is a block diagram of the present invention 10 wherein the potential energy of the sun 20 is harvested by at least one solar cell 22 and directed by the electrical circuit 46 to energize at least one rechargeable battery 48 to selectively activate the LED 32 with the on/off switch 56.

Figure 10:
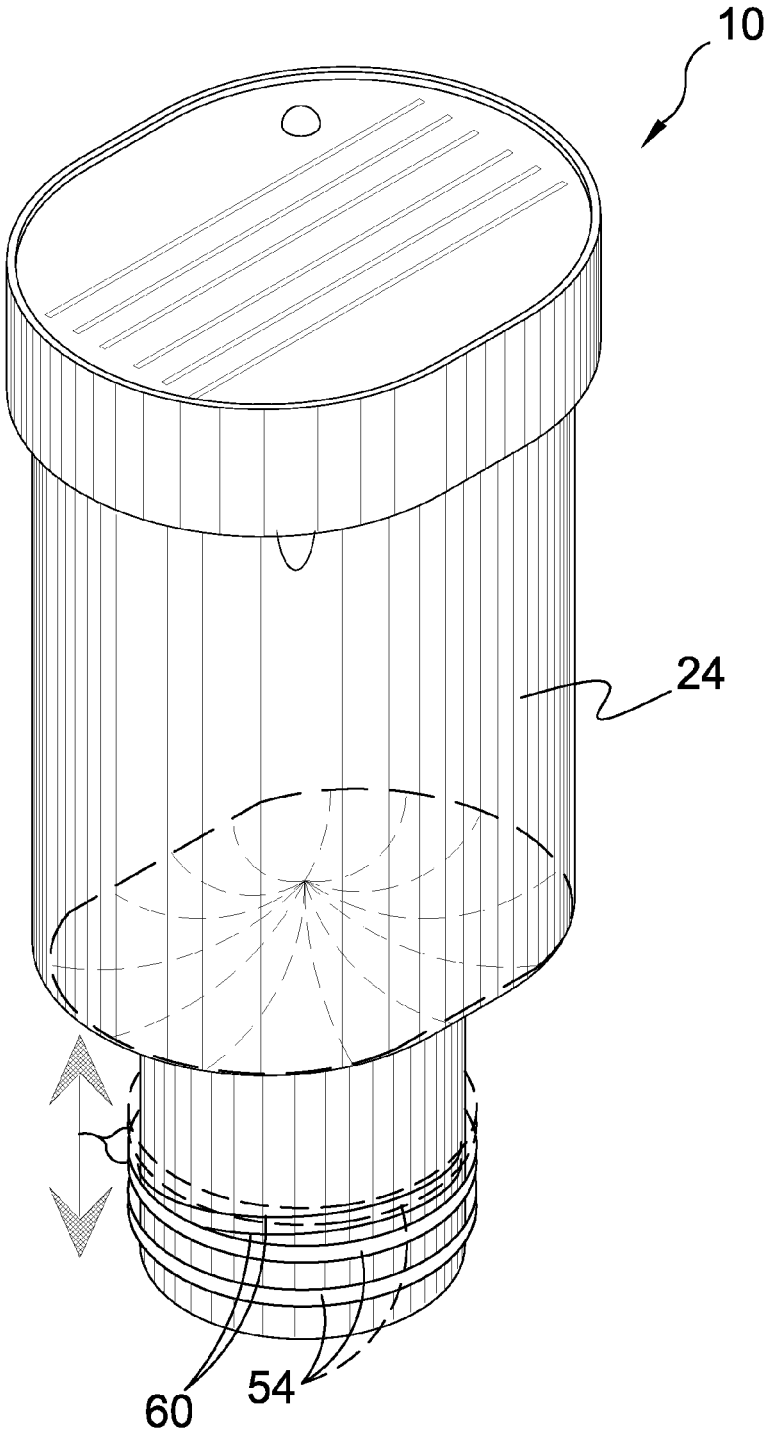
FIG. 10 is a perspective view of an additional element of the present invention.

FIG. 10 is a perspective view of an additional element of the present invention 10. Shown is the housing 24 having an overall oval form, rather than a circle or cylinder. Additionally the main housing 24 or structure of the present invention 10 can be constructed in any extending form or shape as desired with ridges 54 forming the universal receiver for a shade or other ornamental device 52 as shown in FIG. 11 providing also for one or both of ridges 54 displaceable either frictionally or via threads 60.

Figure 11:
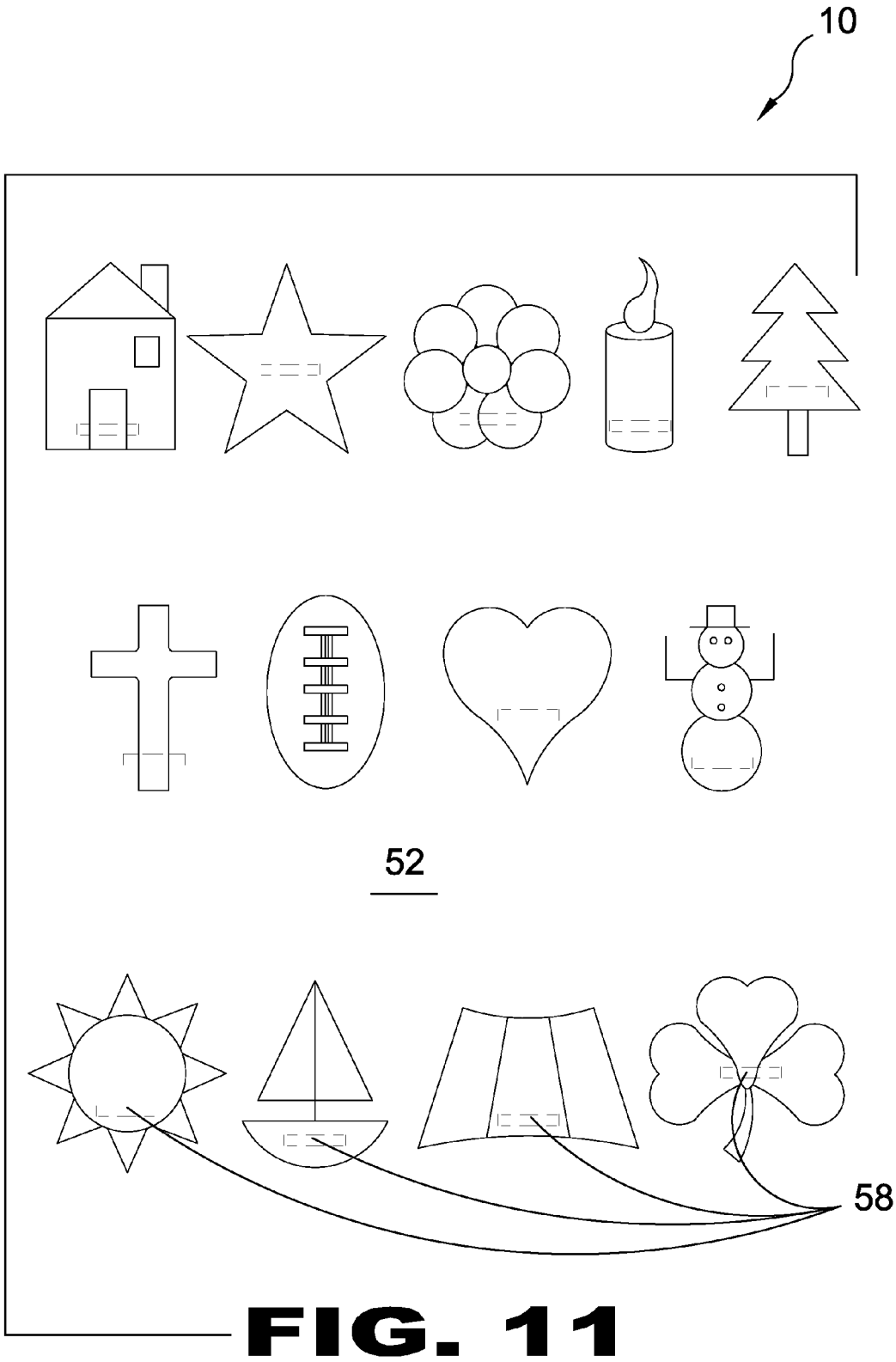
FIG. 11 is an illustrative view of a plurality of possible shade designs of the present invention.

FIG. 11 is an illustrative view of a plurality of possible shade 52 designs that may be attached to the present invention 10 to dim released light and to improve or switch the present inventions 10 aesthetic appearance and value as desired.

Figure 12:
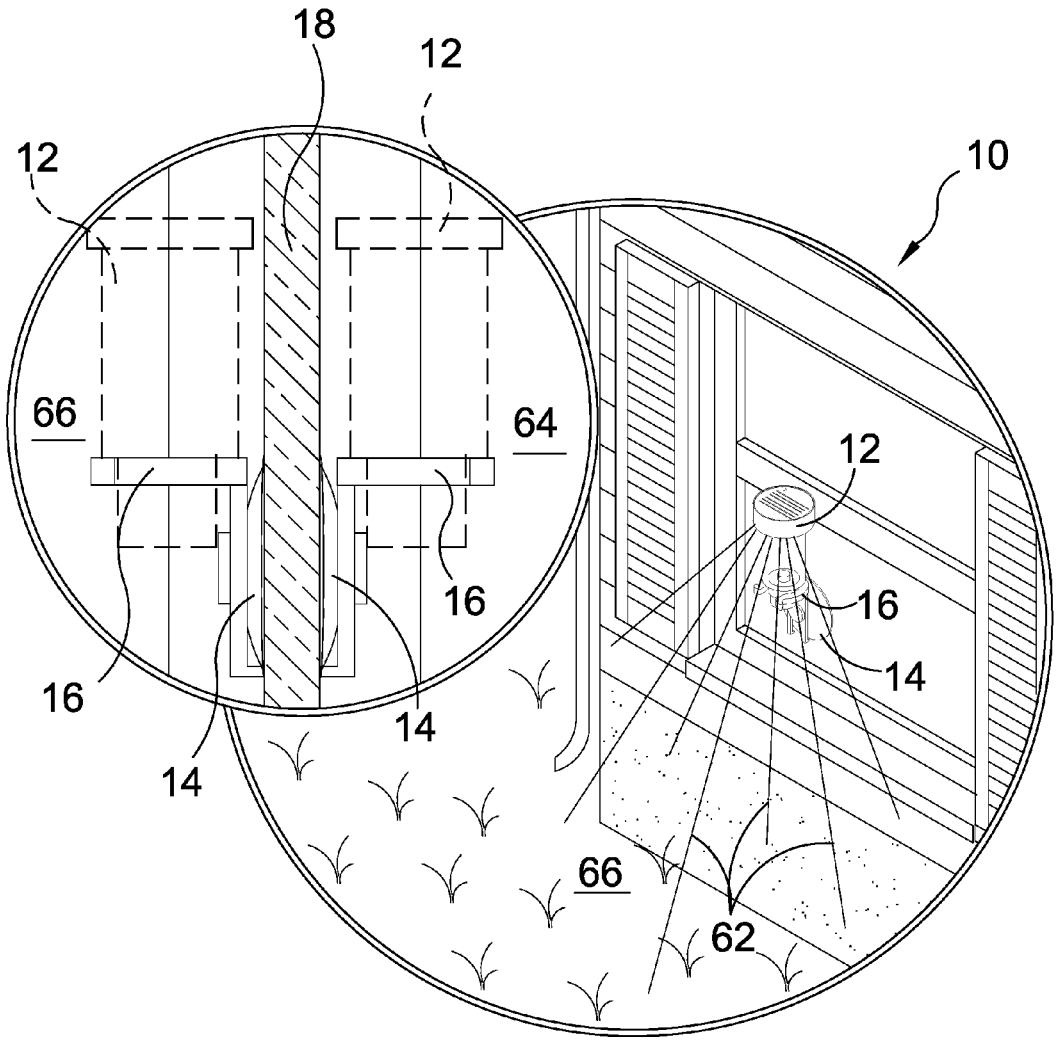
FIG. 12 is an illustrative view of an exterior structure application.

FIG. 12 is an illustrative view of an exterior structure application. As aforementioned, the solar powered night light 10 is comprised of structural attachment fastener 14, lighting module 12 and holder 16 for attaching the lighting module 12 to window 18 to harvest potential energy from the sun 20. It is also envisioned that the solar powered night light 10 can serve in fashion as a security light by attaching the solar powered night light to the exterior 66 side of window 18 where then light beams 62 provide illumination to the interior structure 64 as well as to the exterior 66 of the structure acting to deter intruders from window areas.

Figure 13:
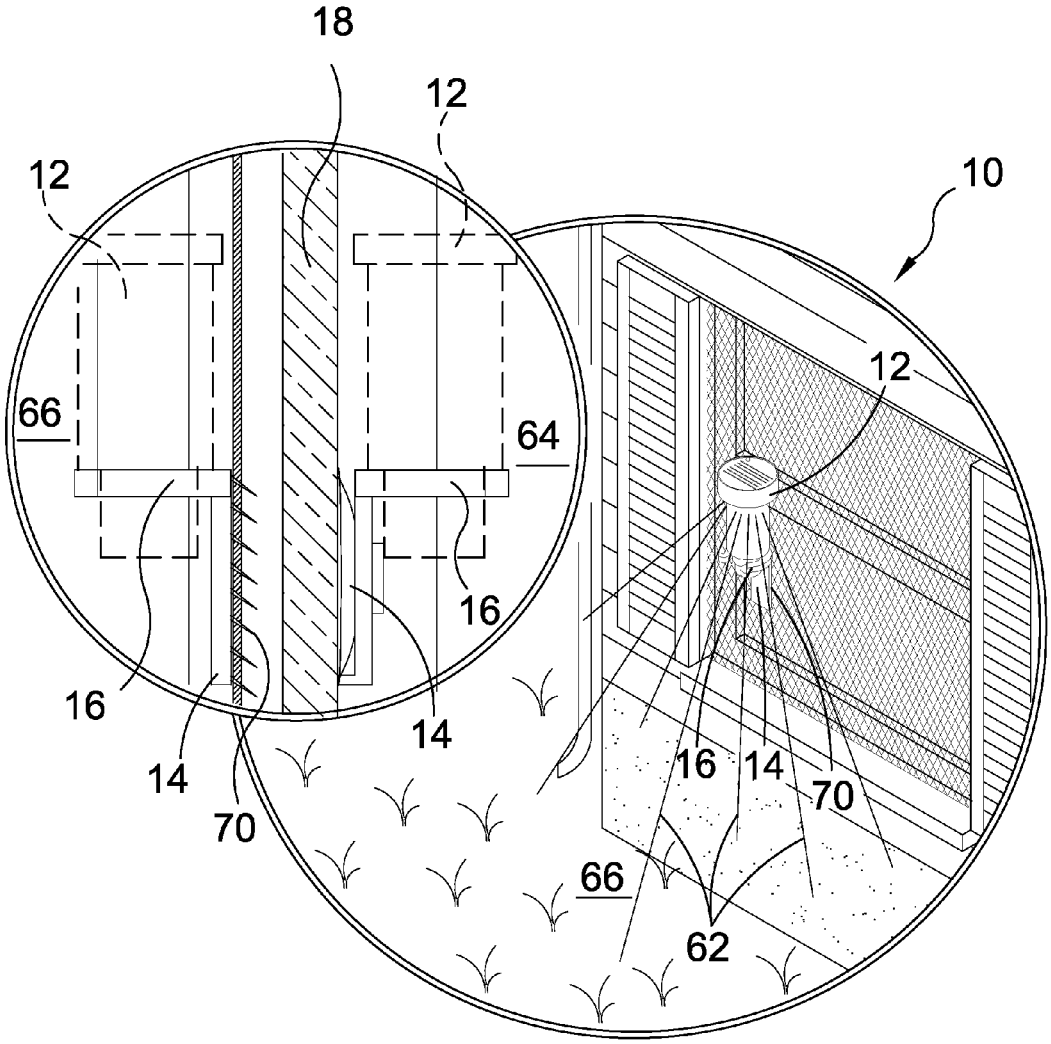
FIG. 13 is an illustrative view of an exterior screen attachment application.

FIG. 13 is an illustrative view of an exterior screen attachment application. Shown is an additional application of the solar powered night light 10 serving to illuminate the interior 64 of a structure as well as the exterior 66 of the structure by providing at least one hook-like member 70 attachable to screen 68 to provide light beams 62 to illuminate the exterior window area 66.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A solar powered night light comprising:

a lighting module, the lighting module having a housing with upper and lower tubular sections, the upper housing section has a diameter that is larger than said lower housing section, a transition joining said upper and lower housing sections, a solar cell removably disposed over an upper end of said upper housing section, said upper housing section having a reflector disposed in a lower end thereof, and a lighting circuit disposed in an upper end of said upper housing, said lighting circuit including at least one rechargeable battery and at least one light emitting diode; and a holder for securing the lighting module to a window, the holder removably supporting the lighting module thereon, said holder having a pair of arms with a central opening for receiving said lower housing section therein, said pair of arms having a pair of legs extending downwardly therefrom, said legs forming an open slot, said open slot receiving a stud of a suction cup therein.

2. The solar powered night light of claim 1, wherein said reflector is supported by said transition.

3. The solar powered night light of claim 1, further comprising:

a shade with a shade attachment clip, said shade attachment clip removably connecting said shade to said lower housing section.

4. The solar powered night light of claim 1, wherein said upper housing section has a shape selected from the group consisting of round, oval, rectangular, and square, and the solar cell has the same shape.

5. The solar powered night light of claim 1, wherein said open slot has a closed end, a pin disposed at said closed end, said pin received by an aperture in said stud to prevent rotation of said suction cup relative to said holder.

6. The solar powered night light of claim 1, further including a light diffusing portion.

7. The solar powered night light of claim 1, wherein said legs have an upper surface and said lower end of said upper housing section is supported on said upper surface.

8. The solar powered night light of claim 3, wherein said shade includes an ornamental design or an ornamental shape.

9. The solar powered night light of claim 1, wherein said reflector has a periphery with substantially the shape as the upper housing section and said reflector has a raised central portion.

10. A solar powered night light comprising:

a lighting module, the lighting module having a housing with upper and lower tubular sections, the upper housing section has a diameter that is larger than said lower housing section, a transition joining said upper and lower housing sections, a solar cell removably disposed over an upper end of said upper housing section, said upper housing section having a reflector disposed in a lower end thereof, and a lighting circuit disposed in an upper end of said upper housing, said lighting circuit including at least one rechargeable battery and at least one light emitting diode; and a holder for securing the lighting module to a window screen, the holder removably supporting the lighting module thereon, said holder having a pair of arms with a central opening for receiving said lower housing section therein, said pair of arms having a planar member extending downwardly therefrom, said planar member having a plurality of pointed members extending therefrom, said pointed fasteners being capable of extending through the window screen and securing the holder thereto.

11. The solar powered night light of claim 9, wherein said reflector is supported by said transition.

12. The solar powered night light of claim 9, wherein said upper housing section has a shape selected from the group consisting of round, oval, rectangular, and square, and the solar cell has the same shape.

13. The solar powered night light of claim 9, further including a light diffusing portion.

14. The solar powered night light of claim 9, wherein said reflector has a periphery with substantially the shape as the upper housing section and said reflector has a raised central portion.

* * * * *